United States Patent [19]

Kawano et al.

[11] Patent Number: 4,457,674

[45] Date of Patent: Jul. 3, 1984

[54] HIGH EFFICIENCY SCROLL TYPE COMPRESSOR WITH WRAP PORTIONS HAVING DIFFERENT AXIAL HEIGHTS

[75] Inventors: Akihiro Kawano; Kiyoshi Terauchi, both of Gunma, Japan

[73] Assignee: Sanden Corporation, Japan

[21] Appl. No.: 433,897

[22] Filed: Oct. 12, 1982

[30] Foreign Application Priority Data

Oct. 12, 1981 [JP] Japan ..... 56-162210

[51] Int. Cl.[3] ..... F04C 18/02; F04C 23/00

[52] U.S. Cl. ..... 418/5; 418/55

[58] Field of Search ..... 418/5, 6, 55, 59

[56] References Cited

U.S. PATENT DOCUMENTS 3,874,827 4/1975 Young ..... 418/55

4,157,234 6/1979 Weaver et al. ..... 418/55

*Primary Examiner*—John J. Vrablik

*Attorney, Agent, or Firm*—Banner, Birch, McKie & Beckett

[57] ABSTRACT

An efficient scroll type compressor is disclosed which has a large number of spiral turns, yet yields gradual, controlled compression. The compressor includes a housing, a fixed scroll and an orbiting scroll. The fixed scroll is fixedly disposed relative to the housing and has a circular end plate from which a first spiral wrap extends. The orbiting scroll has a circular end plate from which a second spiral wrap extends. The spiral wraps interfit at an angular and a radial offset to make a plurality of line contacts to define at least one pair of sealed off fluid pockets. The fluid pockets move toward the center of the spiral wraps with consequent reduction of their volume by the orbital motion of the orbiting scroll. The spiral wrap of each scroll has a transition portion between a higher inner portion of the spiral, and a lower outer portion thereof. The circular end plate of each scroll is provided with a stepped portion between a deeper inner portion of the end plate and a shallower outer portion thereof. The opposed transition and stepped portions are in registry, so that the higher spiral portions engage the deeper end plate portions, and the shorter spiral portions engage the shallower end plate portions.

10 Claims, 19 Drawing Figures

FIG. 5a
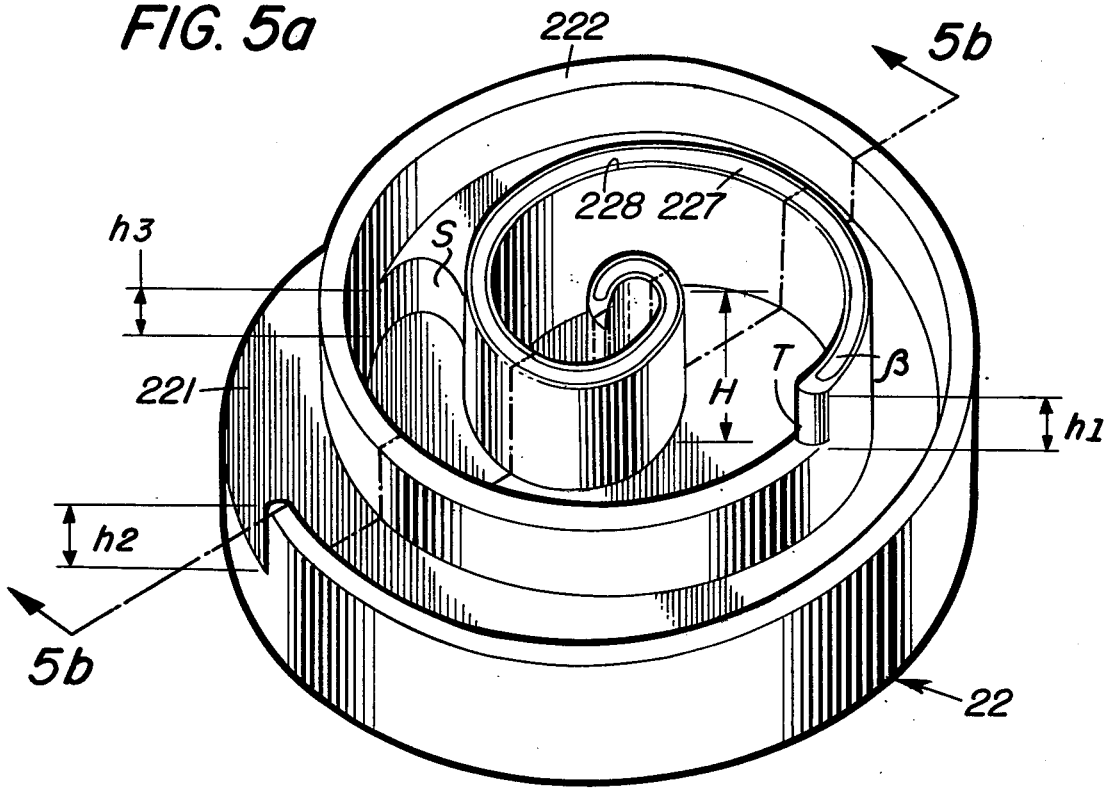
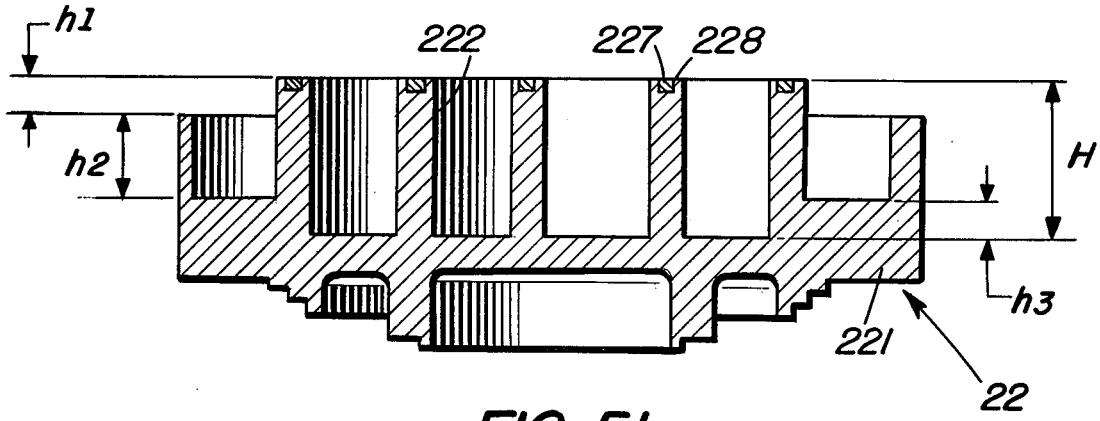
FIG. 5b

FIG. 9a
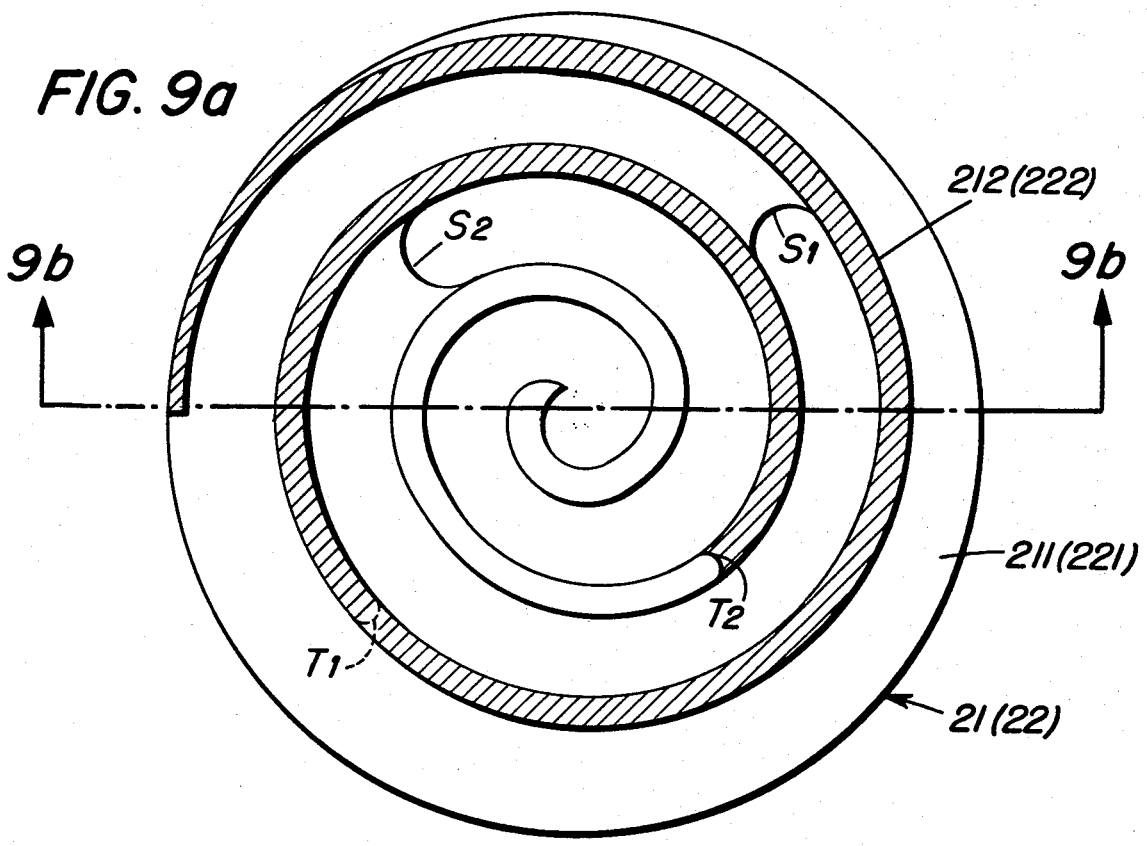
FIG. 9b
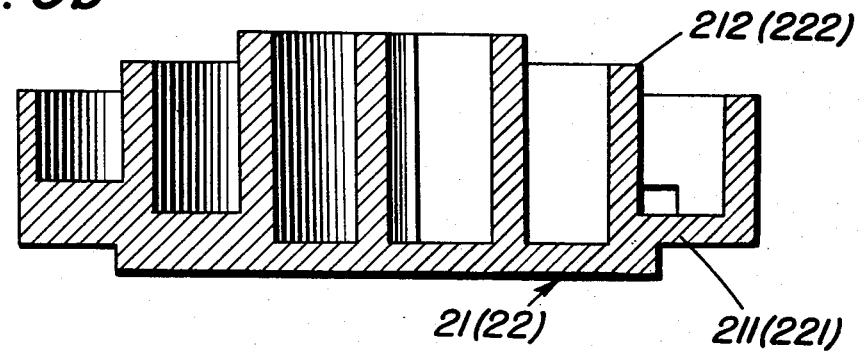
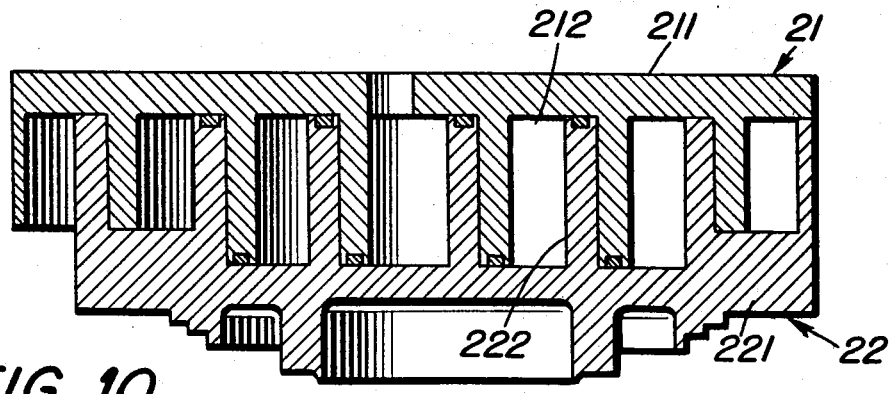
FIG. 10

HIGH EFFICIENCY SCROLL TYPE COMPRESSOR WITH WRAP PORTIONS HAVING DIFFERENT AXIAL HEIGHTS

BACKGROUND OF THE INVENTION

This invention relates to a fluid displacement apparatus of the scroll type, such as a compressor.

Scroll type fluid displacement apparatus are well known in the prior art. For example, U.S. Pat. No. 801,182 discloses a scroll type fluid displacement apparatus including two scroll members, each having a circular end plate and a spiroidal or involute spiral element. These scroll members are maintained angularly and radially offset so that both spiral elements interfit to make a plurality of line contacts between the spiral curved surfaces to thereby seal off and define at least one pair of fluid pockets. The relative orbital motion of the two scroll members shifts the line contacts along the spiral curved surfaces and, therefore, the fluid pockets change in volume. The volume of the fluid pockets increases or decreases depending on the direction of the orbiting motion. Therefore, the scroll type fluid displacement apparatus is applicable to compress, expand or pump fluids.

The principle of operation of a typical scroll type compressor will be described with reference to FIGS. 1*a*–1*d* and FIG. 2. FIGS. 1*a*–1*d* schematically illustrate the relative movement of interfitting spiral elements to compress the fluid. FIG. 2 diagrammatically illustrates the compression cycle in each of the fluid pockets. FIGS. 1*a*–1*d* may be considered to be end views of a compressor wherein the end plates are removed and only the spiral elements are shown.

Two spiral elements 1 and 2 are angularly and radially offset and interfit with one another. As shown in FIG. 1*a*, the orbiting spiral element 1 and fixed spiral element 2 make four line contacts as shown at four points A, B, C, D. A pair of fluid pockets 3*a* and 3*b* are defined between line contacts D-C and line contacts A-B, as shown by the dotted regions. The fluid pockets 3*a* and 3*b* are defined not only by the wall of spiral elements 1 and 2 but also by the end plates from which these spiral elements extend. When orbiting spiral element 1 is moved in relation to fixed spiral element 2 by, for example, a crank mechanism, so that the center O' of orbiting spiral element 1 revolves around the center O of fixed spiral element 2 with a radius of O—O', while rotation of the orbiting spiral element is prevented, the pair of fluid pockets 3*a* and 3*b* shift angularly and radially towards the center of the interfitted spiral elements with the volume of each fluid pocket 3*a* and 3*b* being gradually reduced, as shown in FIGS. 1*a*–1*d*. Therefore, the fluid in each pocket is compressed.

Now, the pair of fluid pockets 3*a* and 3*b* are connected to one another while passing the stage from FIG. 1*c* to FIG. 1*d* and as shown in FIG. 1*a*, both pockets 3*a* and 3*b* merge at the center portion 5 and are completely connected to one another to form a single pocket. The volume of the connected single pocket is further reduced by further revolution of 90° as shown in FIGS. 1*b*, 1*c* and 1*d*. During the course of revolution, outer spaces which open in the state shown in FIG. 1*b* change as shown in FIGS. 1*c*, 1*d* and 1*a*, to form new sealed off fluid pockets in which fluid is newly enclosed.

Accordingly, if circular end plates are disposed on, and sealed to, the axial facing ends of spiral elements 1 and 2, respectively, and if one of the end plates is provided with a discharge port 4 at the center thereof as shown in figures, fluid is taken into the fluid pockets at the radial outer portion and is discharged from discharge port 4 after compression.

Referring to FIG. 2 and FIG. 1, the compression cycle of fluid in one fluid pocket will be described. FIG. 2 shows the relationship of fluid pressure in the fluid pocket to crank angle, and shows that one compression cycle is completed at a crank angle of $4\pi$, in this case.

The compression cycle begins (FIG. 1*a*) when the fluid pockets are sealed, i.e., with the outer end of each spiral element in contact with the opposite spiral element, the suction phase having finished. The state of fluid pressure in a fluid pocket is shown at point h in FIG. 2. The volume of the fluid pocket is reduced and fluid is compressed by the revolution of the orbiting scroll until the crank angle reaches $2\pi$, which state is shown by the point l in FIG. 2. Immediately after passing this state, and hence, passing point l, the pair of fluid pockets are connected to one another and simultaneously are connected to the space filled with high pressure, which is left undischarged at the center of both spiral elements. At this time, if the compressor is not provided with a discharge valve, the fluid pressure in the connected fluid pockets suddenly rises to equal the pressure in the discharge chamber. If, however, the compressor is provided with a discharge valve, such as a reed valve, the fluid pressure in the connected fluid pockets rises slightly due to the mixing of the high pressure fluid and the fluid in the connecting fluid pockets. This state is shown at point m in FIG. 2. The fluid in the high pressure space is further compressed by revolution of the orbiting scroll until it reaches the discharge pressure. This state is shown at point n in FIG. 2. When the fluid in the high pressure space reaches the discharge pressure (as determined by the spring constant of the reed valve and the area of the discharge port), the fluid is discharged to the discharge chamber through the discharge port by the automatic operation of the reed valve. Therefore, the fluid in the high pressure space is maintained at the discharge pressure until a crank angle of $4\pi$ (point o in FIG. 2) is reached.

Accordingly, one cycle of compression is completed at a crank angle of $4\pi$, but the next cycle begins at the mid-point of compression of the first cycle as shown by points h', l' and m' and the dot-dash line in FIG. 2. Therefore, fluid compression proceeds continuously by the operation of these cycles.

There are advantages to designing a scroll type compressor wherein each compression cycle is completed at a crank angle of $6\pi$, rather than $4\pi$. Such a compressor naturally would have a greater number of turns in its spirals. FIG. 3 illustrates the compression cycle of fluid in this compressor.

Referring to FIG. 3, the pressure changes in one fluid pocket due to the orbital motion is shown by points h, l, m, n, o, and p. In comparison with the above mentioned compressor cycle which is completed at a crank angle of $4\pi$, the pressure differential between the adjacent fluid pockets of this compressor will be smaller. Therefore, the amount of fluid leakage from the higher pressure fluid pockets to the lower pressure pockets across the line contacts between the sprial curved surfaces is reduced to thereby improve the volumetric efficiency. Furthermore, with the greater number of turns of the spiral elements the swept volume of the compressor advantageously is made larger.

There are disadvantages to this configuration, however. The axial length or height of the spiral elements of a conventional scroll type compressor is uniform so that, with a greater number of turns of the spiral elements, the internal compression ratio of the compressor is increased, thereby increasing the power consumption of the compressor. If this compressor is used in applications requiring a lower compression ratio, overcompression results, the compression cycle in this instance illustrated in FIG. 3 by points h, l, n'', o and p. This cycle resembles that for a compressor which is not provided with a reed valve—a cycle indicative of excessive power loss.

SUMMARY OF THE INVENTION

It is a primary object of this invention to provide an efficient scroll type compressor having a large number of spiral turns in its scrolls.

It is another object of this invention to provide such a scroll type compressor wherein the internal compression ratio and the power loss of the compressor are kept low in spite of the large number of turns of the spiral elements.

It is still another object of this invention to realize the above objects with a simple compressor construction.

A scroll type compressor according to this invention includes a housing and a pair of scroll members. One of the scroll members is fixedly disposed relative to the housing and has an end plate from which a first spiral wrap extends axially into the interior of the housing. The other scroll member is movably disposed for non-rotative orbital movement within interior of the housing and has an end plate from which a second spiral wrap extends. The first and second sprial wraps interfit at an angular and radial offset to make a plurality of line contacts to define at least one pair of fluid pockets. A driving mechanism is operatively connected to the orbiting scroll member to effect its orbital motion, whereby the fluid pockets move inwardly and change in volume. A transition portion of the spiral wrap of one of the scrolls defines an inner wrap portion (extending inwardly of the transition portion) and an outer wrap portion (extending outwardly of the transition portion). The inner wrap portion has a greater axial length or height than the outer wrap portion. A stepped portion on the end plate of the other scroll member is generally in registry with the transition portion. The stepped portion defines an inner end plate portion (extending within the wrap affixed to its end plate from the stepped portion toward the center of the scroll), and an outer end plate portion (extending within the wrap toward the periphery of the scroll). The inner end plate portion is deeper than the outer end plate portion to accommodate the higher inner wrap portion therein.

Further objects, features and aspects of this invention will be understood from the following detailed description of certain preferred embodiments of this invention, referring to the annexed drawings.

BRIEF DESCRIPTION OF THE DRAWINGS

FIG. 5*a* is a perspective view of the orbiting scroll used in the compressor in FIG. 4;

FIG. 5*b* is a vertical sectional view taken along line 5*b*—5*b* in FIG. 5*a*;

FIG. 9*a* is a front end view of the fixed scroll according to another embodiment of this invention;

FIG. 9*b* is a vertical sectional view taken along line 9*b*—9*b* in FIG. 9*a*; and FIG. 10 is a vertical sectional view illustrating the interfitting relationship of both scrolls according to still another embodiment of the invention.

DETAILED DESCRIPTION OF PREFERRED EMBODIMENTS

Figure 4:
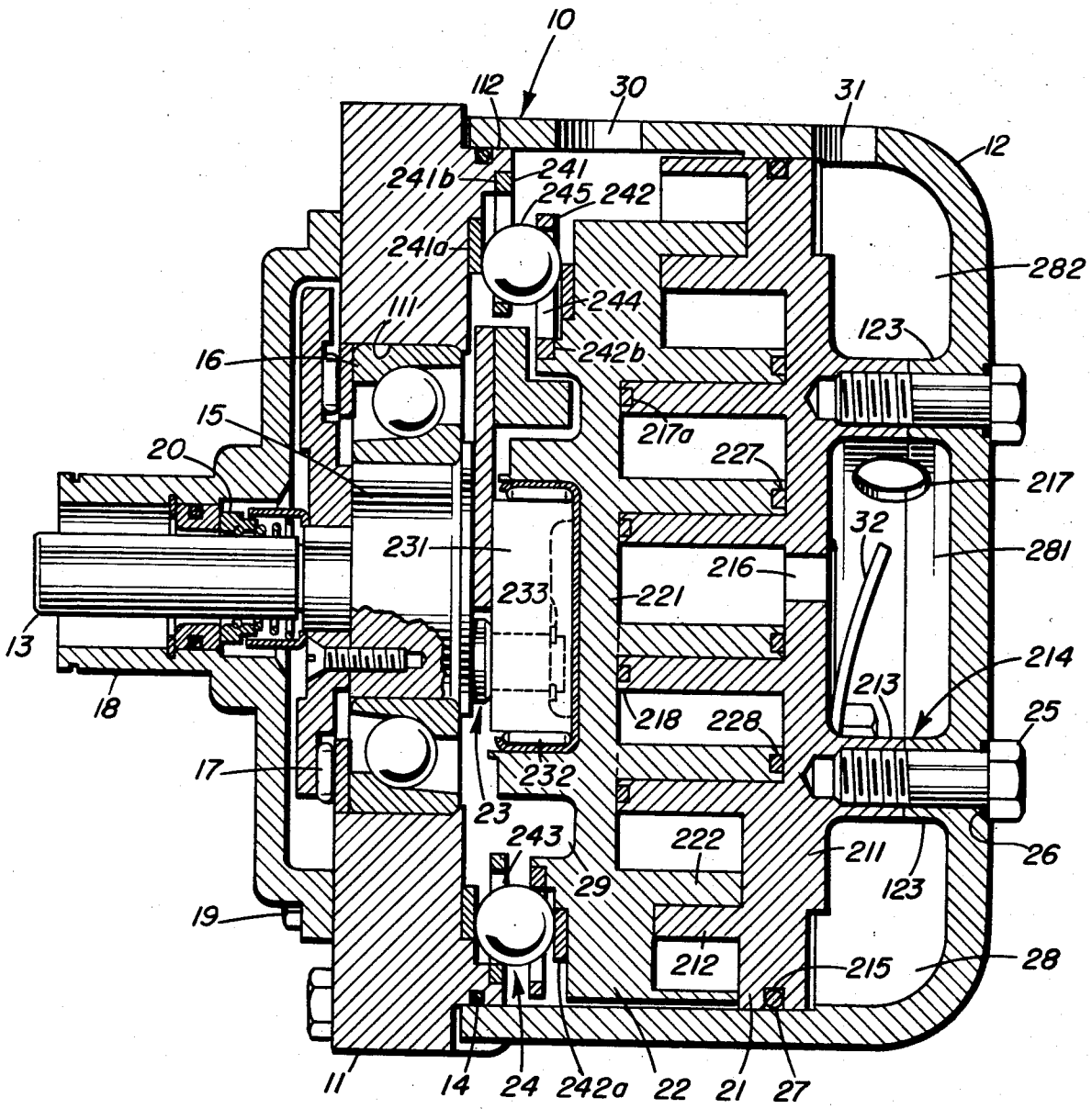
FIG. 4 is a vertical sectional view of a compressor of the scroll type according to this invention.

Referring to FIG. 4, a scroll type refrigerant compressor according to this invention is shown. The compressor includes a compressor housing 10 having a front end plate 11 and a cup shaped casing 12 fastened to an end surface of front end plate 11. An opening 111 is formed on the center of front end plate 11 for supporting a drive shaft 13. An annular projection 112, concentric with opening 111, is formed on the rear end surface of front end plate 11. Annular projection 112 fits into an inner wall of the opening of cup shaped casing 12. Cup shaped casing 12 is fixed on the rear end surface of front end plate 11 by suitable fasteners, such as bolts and nuts (not shown), so that the opening of cup shaped casing 12 is covered by front end plate 11. An O-ring 14 is placed between the outer peripheral surface of annular projection 112 and the inner wall of cup shaped casing 12 to seal the mating surfaces between the front end plate 11 and cup shaped casing 12.

Drive shaft 13 is formed with a disk-shaped rotor 15 at its inner end portion. Disk shaped rotor 15 is rotatably supported by front end plate 11 through a bearing 16 located within opening 111 of front end plate 11. Front end plate 11 has an annular sleeve 18 projecting from the front end surface thereof. This sleeve 18 surrounds drive shaft 13 to define a shaft seal cavity. A shaft seal assembly 20 is assembled on drive shaft 13 within the shaft seal cavity. As shown in FIG. 4, sleeve 18 is attached to the front end surface of front end plate 11 by screws 19. Alternatively, sleeve 18 may be formed integral with front end plate 11.

The outer end of drive shaft 13 which extends from sleeve 18 is connected to a rotation transmitting device, for example, a magnetic clutch which may be disposed on the outer peripheral surface of sleeve 18 for transmitting rotary movement to drive shaft 13. Thus drive shaft 13 is driven by an external power source, for example, the engine of a vehicle, through the rotation transmitting device.

A number of elements are located within the inner chamber of cup shaped casing 12 including a fixed scroll 21, an orbiting scroll 22, a driving mechanism 23 for orbiting scroll 22 and a rotation preventing/thrust bearing device 24 formed between the inner wall of cup shaped casing 12 and the rear end surface of front end plate 11.

Fixed scroll 21 includes circular end plate 211, wrap or spiral element 212 affixed to or extending from one end surface of circular end plate 211, and an annular partition wall 213 axially projecting from the end surface of circular end plate 211 on the side opposite spiral element 212. Annular partition wall 213 is formed with a plurality of equiangularly spaced threaded bosses 214 for securing scroll 21 to casing 12. Partition wall 213 and bosses 214 mate with annular partition wall 122 and hollow bosses 123 on the inner surface of end plate portion 121, and are secured to casing 12 by a plurality of bolts 25 (two bolts 25 are shown in FIG. 4). A seal ring 26 is placed under the head of each bolt 25 to prevent fluid leakage past bolts 25.

Circular end plate 211 of fixed scroll 21 thus partitions the inner chamber of cup shaped casing 12 into a discharge chamber 28 having partition walls 213, 122, and suction chamber 29, in which spiral element 212 of fixed scroll 21 is located. A sealing member 27 is disposed within a circumferential groove 215 on circular end plate 211 for sealing the outer peripheral surface of circular end plate 211 to the inner wall of cup shaped casing 12. Since partition walls 213, 122 are located within discharge chamber 28, discharge chamber 28 is partitioned into central space 281 and outer space 282, and both spaces 281 and 282 are connected to one another through a hole 217 formed in partition walls 213, 122.

Orbiting scroll 22, which is disposed in suction chamber 29, includes a circular end plate 221 and wrap or spiral element 222 affixed to and extending from one end surface of circular end plate 221. The spiral elements 212 and 222 interfit at an angular offset of 180° and a predetermined radial offset. The spiral elements define at least one pair of fluid pockets between their interfitting surfaces. Axial sealing elements 217, 227 are retained in end grooves 218, 228 of spiral elements 212, 222 to effect axial sealing with end plates 22, 21.

Orbiting scroll 22 is rotatably supported on a bushing 231 through a bearing such as radial bearing 232. Bushing 231 is connected to a crank pin 233 eccentrically projecting from the end surface of disk-shaped rotor 15. Orbiting scroll 22 is thus rotatably supported on crank pin 233. Therefore, orbiting scroll is moved by the rotation of drive shaft 13.

Rotation preventing/thrust bearing device 24 is placed between the inner end surface of end plate 11 and the end surface of circular end plate 221 of orbiting scroll 22 which faces the inner end surface of front end plate 11. Rotation preventing/thrust bearing device 24 includes a fixed ring 241 which is fastened against the inner end surface of front end plate 11, an orbiting ring 242 which is fastened against the end surface of circular end plate 221, and bearing elements, such as a plurality of spherical balls 245. Both rings 241 and 242 have a plurality of pairs of adjacent circular indentations or holes 243 and 244 and one ball 245 is retained in each of these pairs of holes 243 and 244. As shown in FIG. 4, both rings 241 and 242 are formed by separate plate elements 241*a* and 242*a*, and ring elements 241*b* and 242*b* which have the plurality of pairs of holes 243, 244. The elements of each ring are respectively fixed by suitable fastening means. Alternatively, the plate and ring elements may be formed integral with one another.

In operation, the rotation of orbiting scroll 22 is prevented by balls 245, which interact with the edges of holes 243, 244 to prevent rotation. Also, these balls 245 carry the axial thrust load from orbiting scroll 22. Thus, orbiting scroll 22 orbits while maintaining its angular orientation with respect to fixed scroll 21.

A fluid inlet port 30 and a fluid outlet port 31 are formed on cup shaped casing 12 for communicating between the inner chamber of cup shaped casing 12 and an external fluid circuit. Therefore, fluid or refergerant gas, introduced into suction chamber 29 from an external fluid circuit through inlet port 30, is taken into the fluid pockets formed between spiral elements 212 and 222. As orbiting scroll 22 orbits, fluid in the fluid pockets is moved to the center of the interfitting spiral elements with consequent reduction of volume thereof. Compressed fluid is discharged into discharge chamber 28 from the fluid pocket at the center of the spiral elements through a hole 216 which is formed through circular end plate 211, and a reed valve 32, and therefrom is discharged through outlet port 31 to an external fluid circuit.

Referring to FIGS. 5*a*, 5*b*, 6*a*, 6*b* and 7, the configuration of the scroll members according to this invention will be described in more detail. The configurations of the two scroll members are essentially identical, except that, of course, one is essentially the mirror image of the other. In the description that follows, the term "height" is used to describe the axial extent of a spiral element from its connection with its end plate to its axial end surface.

The outer end portion of spiral element 222 has a height $h_2$. The inner end surface of end plate 221 is formed with a stepped portion S at an arbitrary involute angle $\alpha$ of spiral element 222, on the inner side of spiral element 222 (this point is shown by $O_I$ in FIG. 7, which actually depicts the spiral element of fixed scroll member 21—the mirror image of orbiting scroll member 22). This stepped portion S has a depth $h_3$; the inner portion of end plate 221, which extends inwardly from this stepped portion S to the center of the spiral, is formed deeper than its outer portion, so that the inner portion of spiral element 222 has height of $h_2+h_3$. The end surface of stepped portion S is concavely semicircular with a radius $R_1$; this radius $R_1$ is given by $R_1=r_o+t/2$, where $r_o$ is the orbital radius of the orbiting scroll 22 and t is the wall thickness of the spiral element. This arcurate end surface of stepped portion S provides clearance for mating spiral element 212, which faces stepped portion S, during orbital motion of scroll member 22. Furthermore, spiral element 222 is formed with a transition portion T at position $\alpha-\pi$ angularly offset from the point $O_1$ by $\pi$ radians, where the spiral height is increased by $h_1$. Hence, the inner portion of spiral element 222—i.e., from the inner end of the spiral to the transition portion T, has a height $H=h_1+h_2+h_3$. The end surface of transition portion T is convexly semicircular with a radius of $r_2$. The radius $r_2$ is given by $r_2=t/2$.

Figure 6A:
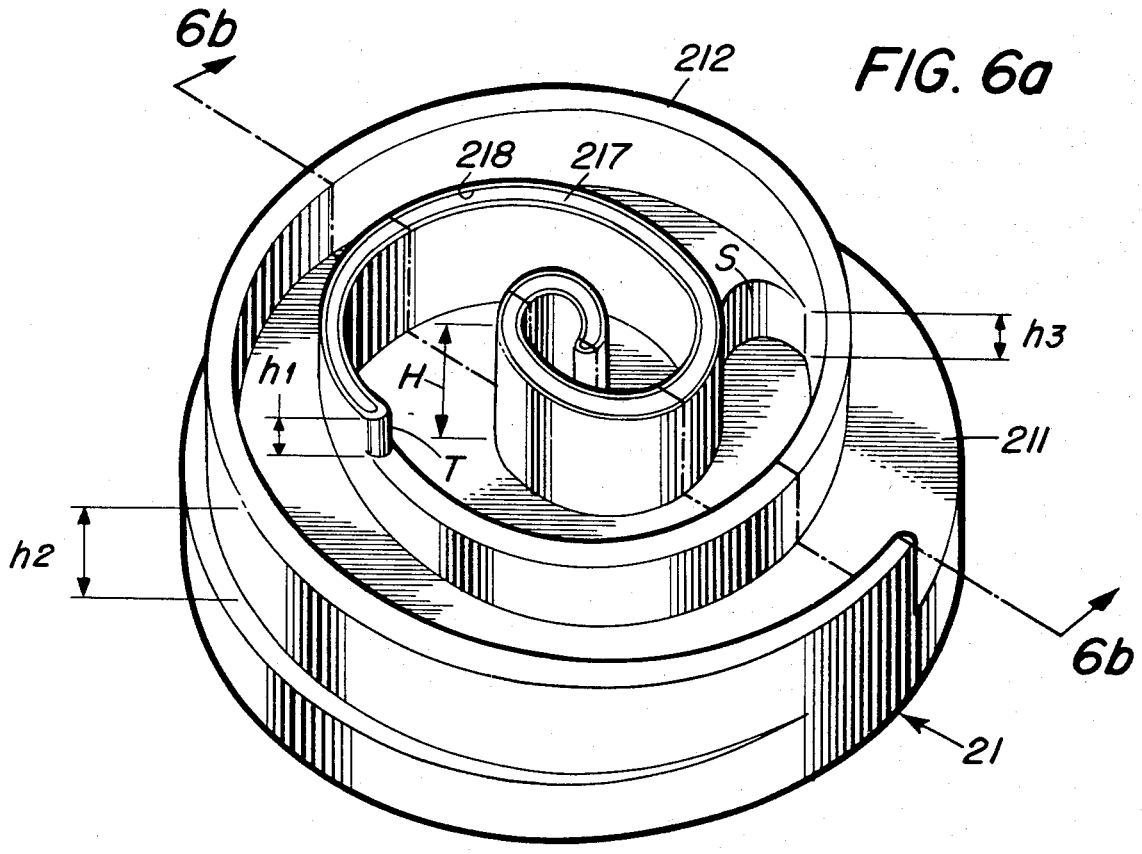
FIG. 6*a* is a perspective view of the fixed scroll used in the compressor in FIG. 4.
Figure 6B:
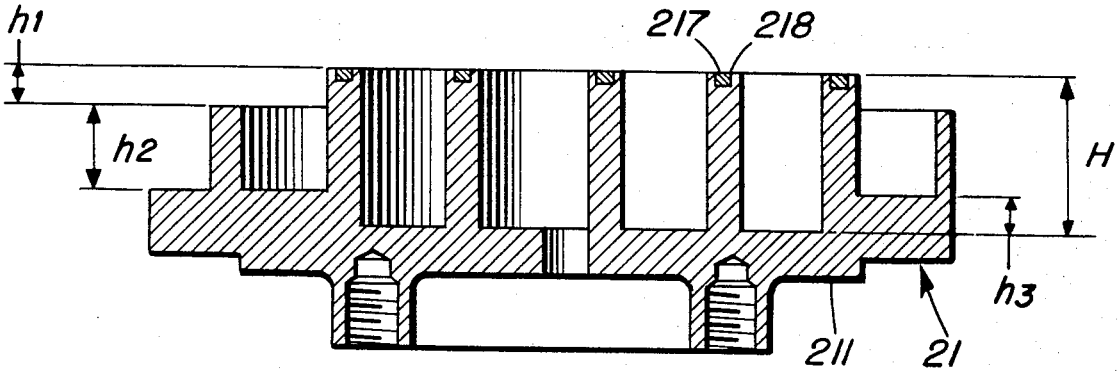
FIG. 6*b* is a vertical sectional view taken along line 6*b*—6*b* in FIG. 6*a*.
Figure 7:
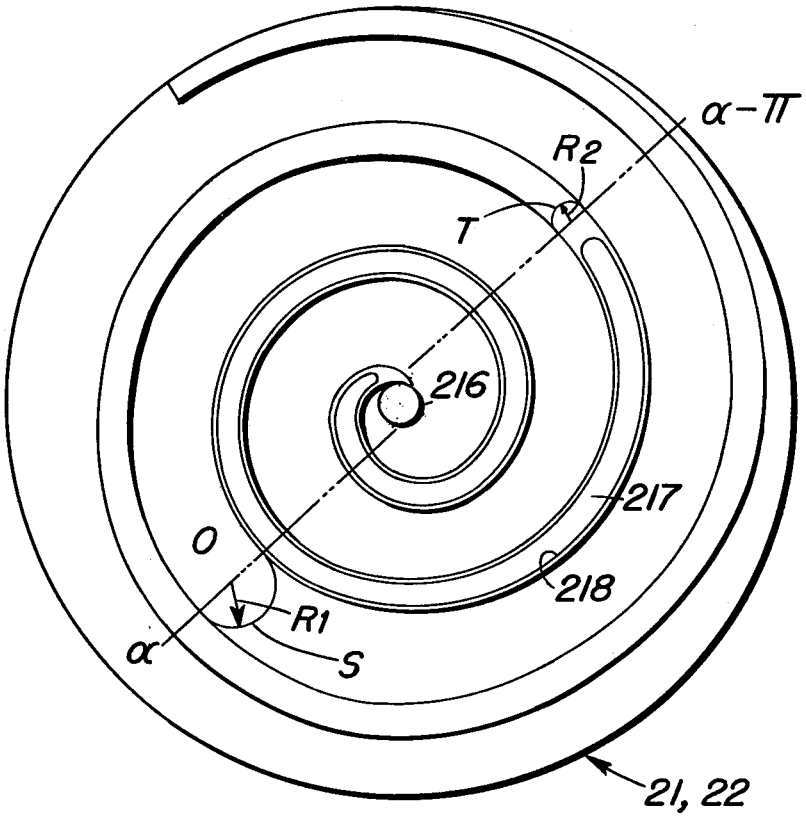
FIG. 7 is a front end view of the fixed scroll used in the compressor in FIG. 4.

As shown in FIGS. 6*a* and 6*b*, the configuration of fixed scroll 21, which mates with orbiting scroll 22, is essentially the mirror image of the configuration of orbiting scroll 22. Thus, a stepped portion S having a depth of $h_3$ is formed on the end surface of circular end plate 211 at a position of point $O_1$ shown in FIG. 7, and spiral element 212 is provided with a transition portion T at a position $\alpha-\pi$ angularly offset from point $O_1$ by $\pi$ radians. Hence, when both scrolls interfit with one another to make a plurality of line contacts, each transition portion T of one scroll is opposed by a stepped portion S of the opposing scroll.

Figure 8A:
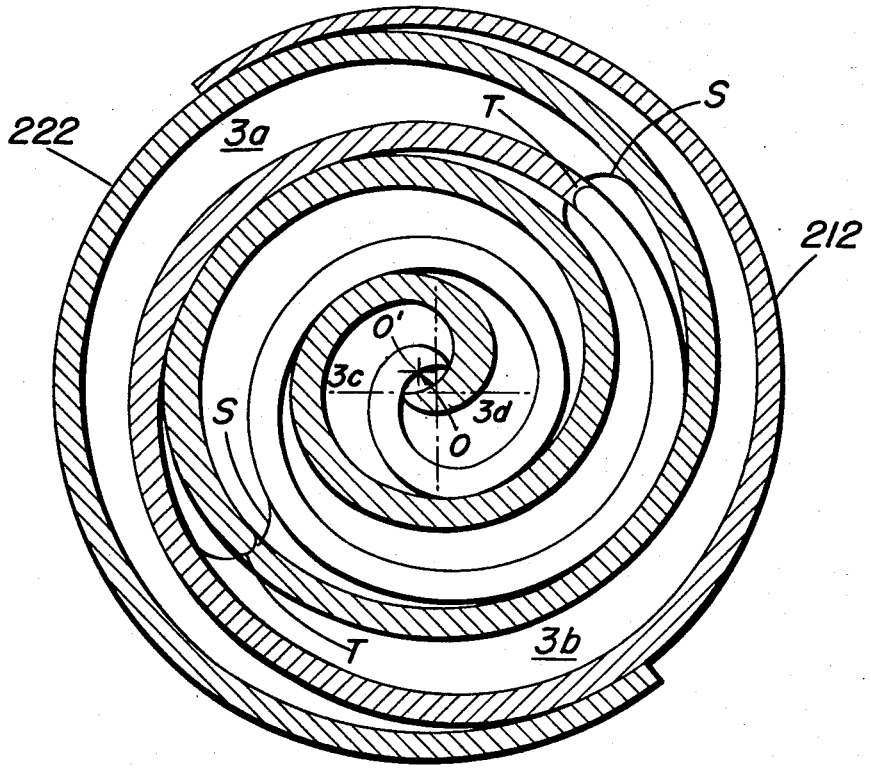
FIGS. 8*a*–8*d* are schematic views illustrating the relative movement of the interfitting spiral elements which are shown in FIG. 4.
Figure 8B:
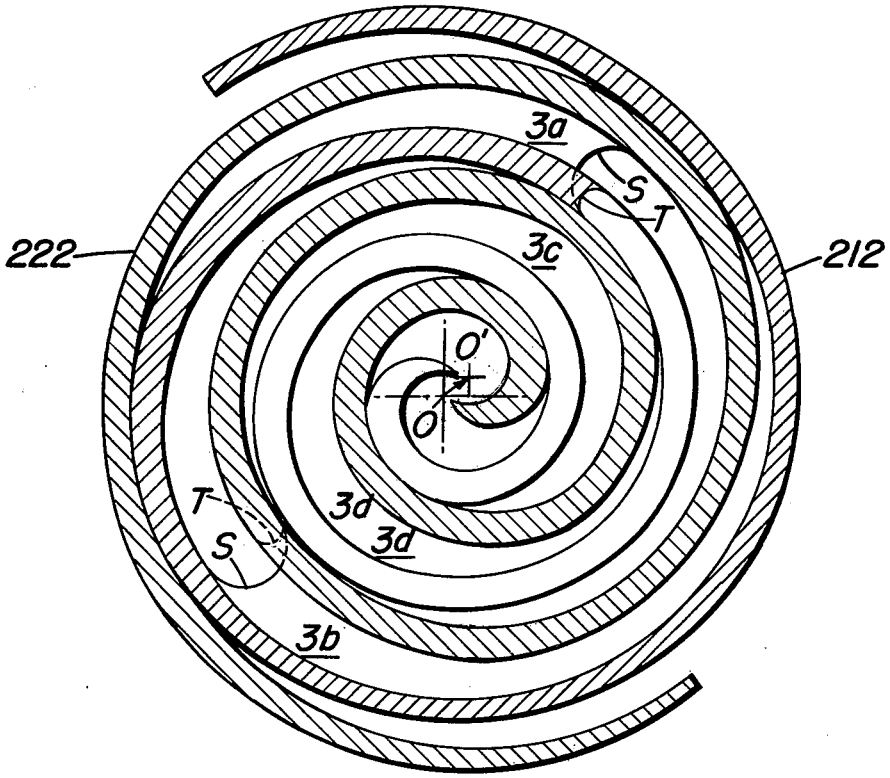

The operation of the above described compressor now will be explained with reference to FIGS. 8*a*–8*d*. As mentioned above, the two spiral elements 212 and 222 are angularly and radially offset and interfit with one another. FIG. 8*a* shows that the outer terminal end of each spiral element is in contact with the other spiral element, i.e., suction just has been completed, and a symmetrical pair of fluid pockets 3*a* and 3*b* just have been formed. For each spiral element stepped portion S is located $1.5\pi$ radians from the outer terminal end of the spiral element. Hence, about three fourths of the part of the spiral element which defines the fluid pockets 3*a* and 3*b* has height $h_2$, and the remainder of the spiral element has height of $h_1+h_2+h_3$. In the stage of compression illustrated in FIG. 8*a*, the end surface of transition portion T of one spiral element interfits with the end surface of the stepped portion S of the opposite scroll, thus sealing off the pair of fluid pockets 3*a* and 3*b*. FIG. 8*b* shows the state of the scroll members at a driveshaft crank angle which is advanced 90° from that in FIG. 8*a*. In this state contact between the transition portion T and the stepped portion S is not resolved, but the line contacts between the spiral elements occur at these portions to seal off the fluid pockets.

Figure 8C:
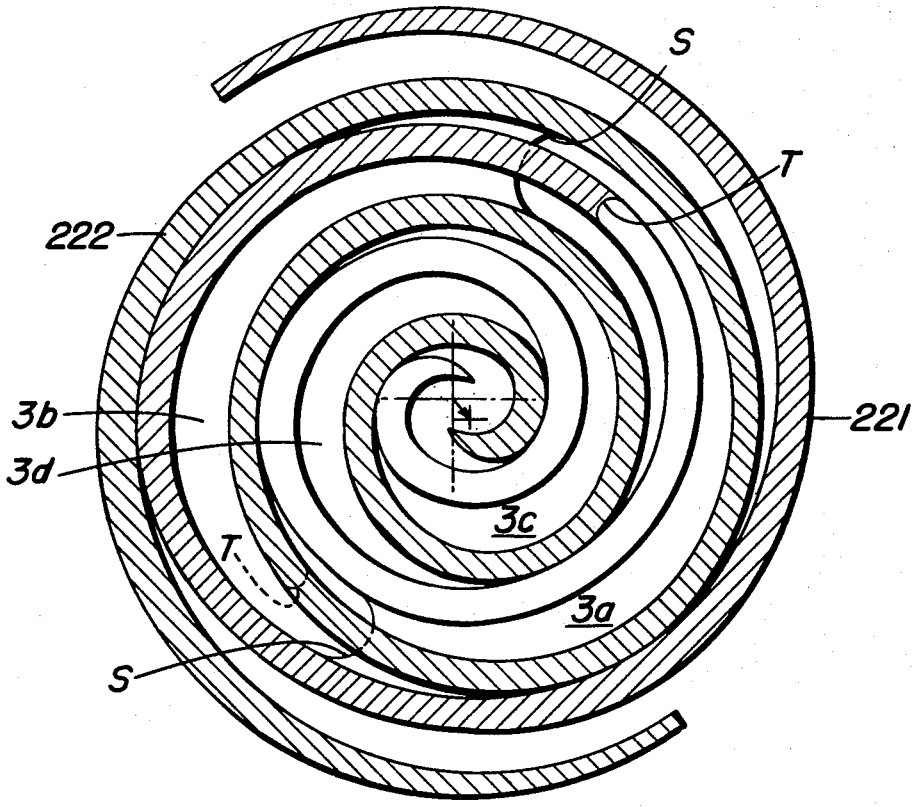
Figure 8D:
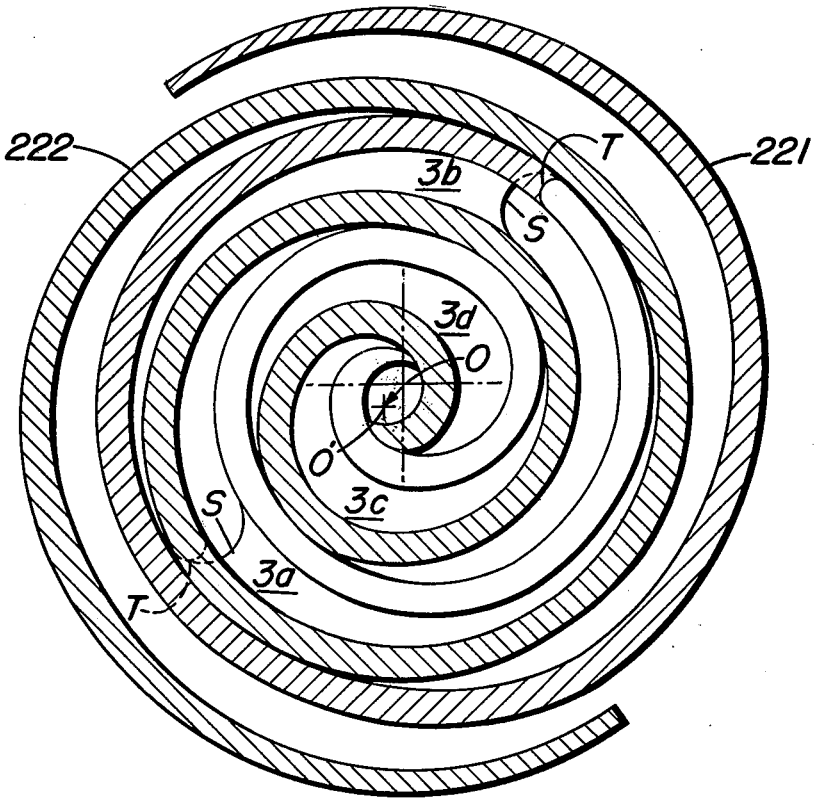

FIG. 8*c* shows the configuration at a further 90° rotation of the drive shaft. In this state, contact between the transition portions T and the stepped portions S has been dissolved, so that the pair of fluid pockets are connected to one another through transition portion T. However, the pair of fluid pockets are symmetrically formed by the scrolls and have the same fluid pressure therein, so that a compression loss does not result. FIG. 8*d* shows the configuration at a further 90° rotation of the drive shaft.

As illustrated in FIGS. 8*a*–8*d*, of the portions of the spirals which define the fluid pockets 3*a*, 3*b*, the percentage constituted by the higher segments (having heights $H=h_1+h_2+h_3$) increases with further rotation of the drive shaft. (In FIG. 8*b*, the pair of fluid pockets 3*c* and 3*d* are defined only by the higher spiral portion which has a height of $h_1+h_2+h_3$.) The reduction of volume of the fluid pockets therefore occurs more gradually than it would in a compressor having spirals of uniform height.

Figure 1A:
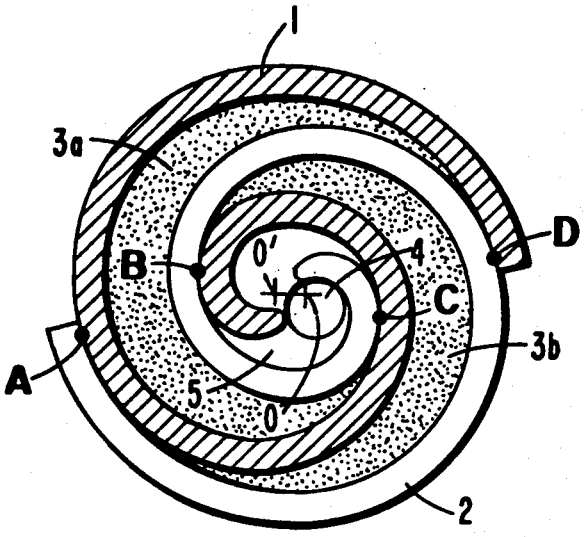
FIGS. 1*a*–1*d* are schematic views illustrating the relative movement of interfitting spiral elements to compress fluid.
Figure 1B:
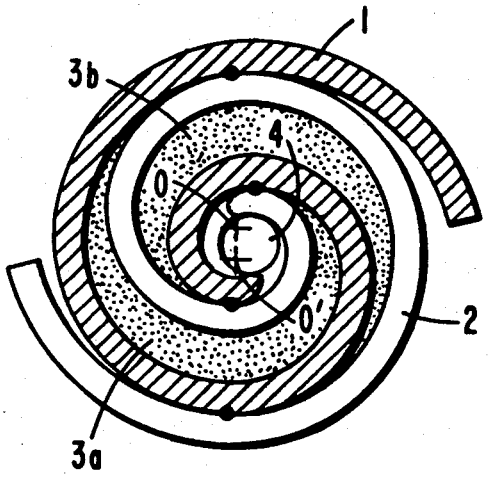
Figure 1C:
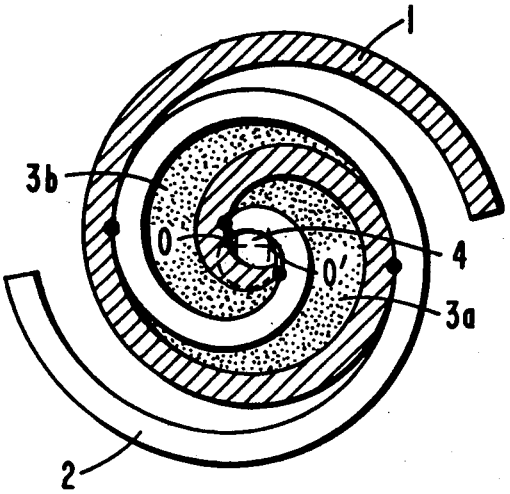
Figure 1D:
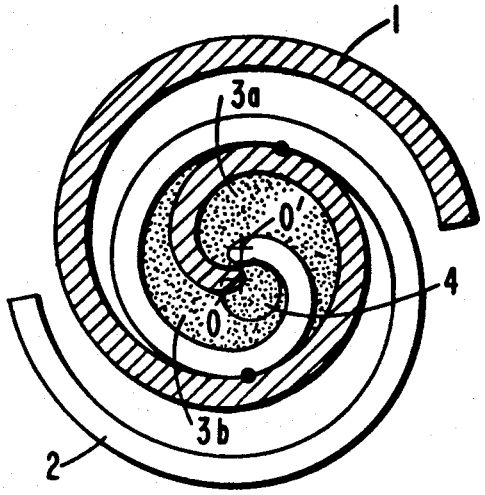
Figure 2:
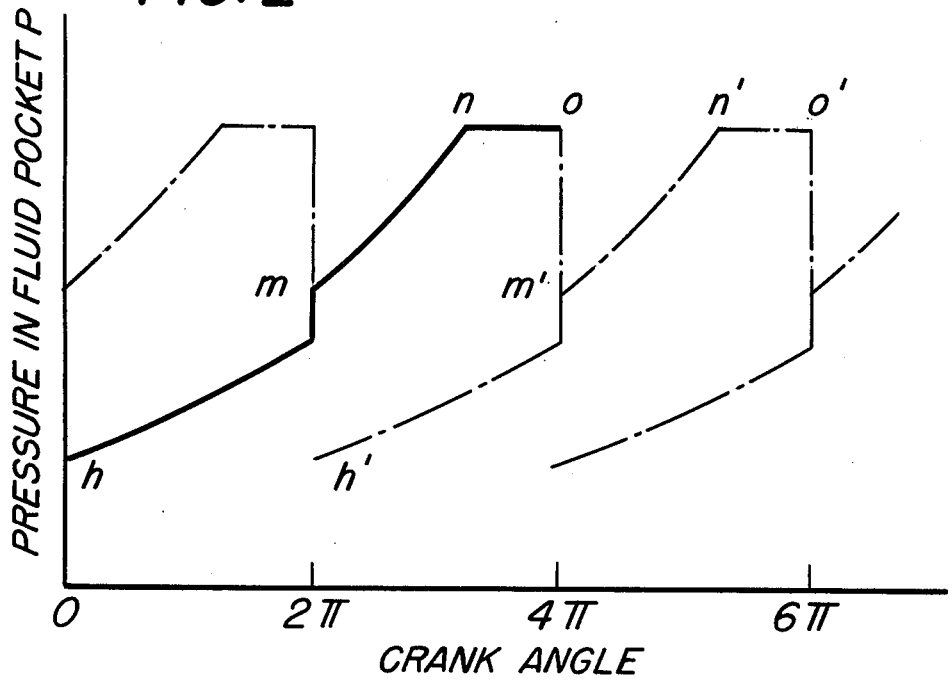
FIG. 2 is a pressure-crank angle diagram illustrating the compression cycle in each of the fluid pockets completed at a crank angle of $4\pi$.
Figure 3:
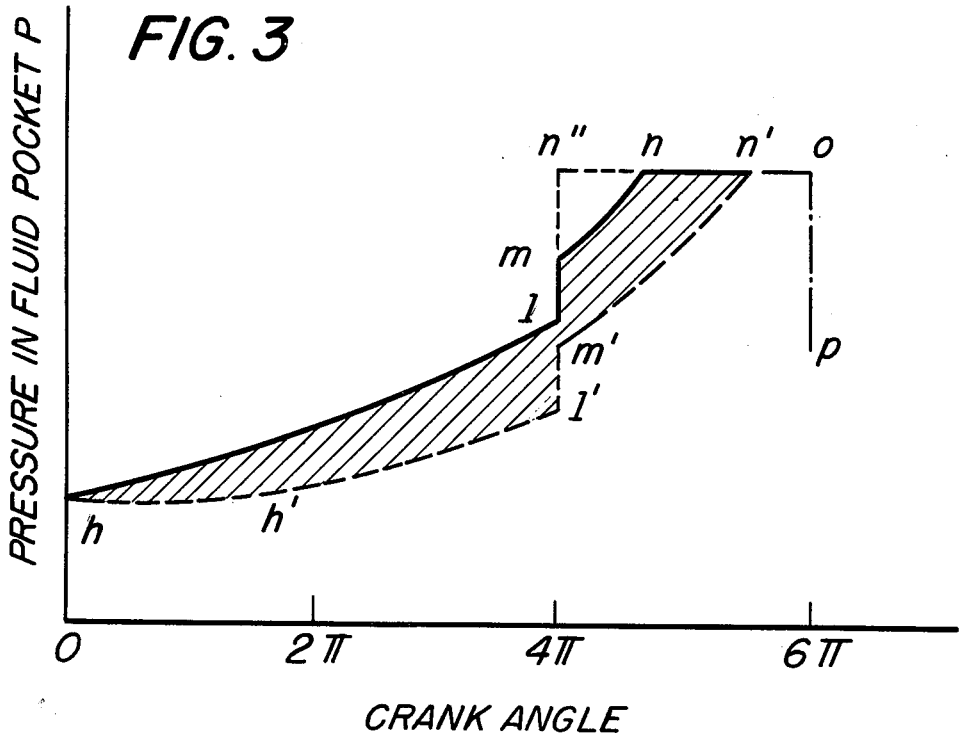
FIG. 3 is a pressure-crank angle diagram illustrating the compression cycle in each of the fluid pockets completed at a crank angle of $6\pi$.

FIG. 3 illustrates the compression cycle of the above described compressor of the invention. In this figure, the compression cycle of this compressor is shown by points h, h', l', m', n', o and p. Also shown is the conventional compression cycle for a compressor having spirals of uniform height: points h, l, m, n, o and p. In comparison with the conventional compression cycle, the ratio of fluid pocket volume reduction to change of crank angle in this invention is smaller. Therefore, the fluid in the pocket is more slowly compressed and the internal compression ratio of the compressor is lower, so that the power required for compression is lower. Also, the pressure differential between the adjacent fluid pockets is reduced, because the fluid in the pockets is more slowly compressed. Therefore, the fluid leakage from the higher pressure space to the lower pressure space is reduced, thereby improving the volumetric efficiency of the compressor.

Referring to FIG. 9, another embodiment is shown. This embodiment is directed to a modification of the scroll which is provided with a plurality of stepped portions and transition portions. In this embodiment, end plates 211 and 221 each are provided with two stepped portions $S_1$ and $S_2$, each of which is arcuate. Also, spiral elements 212, 222 each are provided with two transition portions $T_1$ and $T_2$ each end surface of which is arcuate. In a compressor with these scrolls, the volume reduction ratio of the fluid pockets is even smaller.

Referring to FIG. 10, still another embodiment is shown. This embodiment is directed to a modification of the configuration of the scroll. Circular end plate 211 of fixed scroll 21 is formed with a flat surface and spiral element 212 is provided with a transition portion for changing the spiral height. Spiral element 212 has a higher portion from the transition portion to the internal spiral end. Circular end plate 221 of orbiting scroll 22 has a stepped portion, which also changes the height of the spiral element. There is a difference in the number of turns in the two spiral elements. This difference equalizes the volume of a pair of simultaneously formed fluid pockets, thus balancing the arrangement. An imbalance would otherwise exist if the spiral elements had the same number of turns.

The invention has been described in detail in connection with certain preferred embodiments, but these are examples only and this invention is not restricted thereto. It will be easily understood by those skilled in the art that other variations and modifications can be easily made within the scope of this invention, as defined by the appended claims.

We claim:

1. In a scroll type compressor including a housing having a fluid inlet port and a fluid outlet port, a fixed scroll fixedly disposed relative to said housing and having a circular end plate from which a first spiral wrap extends axially into an operative interior area of said housing, an orbiting scroll having a circular end plate from which a second spiral wrap axially extends, said first and second spiral wraps interfitting at an angular and radial offset to make a plurality of line contacts to define at least one pair of sealed off fluid pockets within said operative interior area, a driving mechanism operatively connected to said orbiting scroll to effect orbital motion of said orbiting scroll so that the volume of the fluid pockets changes during the orbital motion of said orbiting scroll, the improvement comprising:

a transition portion on the spiral wrap of one of said scrolls, said transition portion defining an inner wrap portion extending from said transition portion toward the inner end of the spiral wrap, and defining an outer wrap portion extending from said transition portion toward the outer end of the spiral wrap, said inner wrap portion having a greater axial height than said outer wrap portion; and a stepped portion on the end plate of the other of said scroll members generally in registry with said transition portion, said stepped portion defining an inner end plate portion extending within the wrap affixed to its end plate from said stepped portion toward the center of said other scroll, and defining an outer end plate portion extending within the wrap affixed to its end plate from said stepped portion toward the periphery of said other scroll, said inner end plate portion being deeper than said outer end plate portion to accommodate said inner wrap portion therein.

2. A scroll type compressor according to claim 1 wherein said transition portion and said stepped portion are adapted to mutually effect a fluid seal therebetween during at least a portion of the orbital movement of said orbiting scroll.

3. A scroll type compressor according to claim 1 wherein said transition portion is convexly arcuate, and said stepped portion is concavely arcuate to permit orbital motion of said transition portion adjacent said stepped portion.

4. A scroll type compressor according to claim 1 wherein each of said spiral wraps has a transition portion, and each of said end plates has a stepped portion, opposed transition and stepped portions being in registry.

5. A scroll type compressor according to claim 4 wherein said opposed transition and stepped portions are adapted to mutually effect fluid seals therebetween during at least a portion of the orbital movement of said orbiting scroll member.

6. A scroll type compressor according to claim 4 wherein said transition portions are convexly arcuate, and said stepped portions are concavely arcuate to permit orbital motion of said transition portions adjacent said stepped portions.

7. A scroll type compressor according to claim 4 wherein each of said scrolls has a plurality of transition and stepped portions.

8. In a scroll type compressor including a housing having a fluid inlet port and a fluid outlet port, a fixed scroll fixedly disposed relative to said housing and having a circular end plate from which a first spiral wrap extends axially into an operative interior area of said housing, an orbiting scroll having a circular end plate from which a second spiral wrap axially extends, said first and second spiral wraps interfitting at an angular and radial offset to make a plurality of line contacts to define at least one pair of sealed off fluid pockets within said operative interior area, a driving mechanism operatively connected to said orbiting scroll to effect the orbital motion of said orbiting scroll so that the volume of the fluid pockets changes during the orbital motion of said orbiting scroll, the improvement comprising:

a transition portion on each of said spiral wraps, said transition portion defining an inner wrap portion extending from said transition portion toward the inner end of the spiral wrap, and defining an outer wrap portion extending from said transition portion toward the outer end of the spiral wrap, said inner wrap portion having a greater axial height than said outer wrap portion, and a concavely arcuate stepped portion on each of said end plates generally in registry with the transition portion of the interfitting spiral wrap, said stepped portion defining an inner end plate portion extending within the wrap affixed to its end plate from said stepped portion toward the center of the scroll, and defining an outer end plate portion extending within the wrap affixed to its end plate from said stepped portion toward the periphery of the scroll, said inner end plate portion being deeper than said outer end plate portion to accommodate the interfitting inner wrap portion therein, said stepped portion accommodating orbital motion of said transition portion adjacent thereto.

9. A scroll type compressor according to claim 8 wherein said transition portions and said stepped portions are adapted to mutually effect fluid seals therebetween during at least a portion of the orbital movement of said orbiting scroll.

10. A scroll type compressor according to claim 9 wherein said transition portion is a convex semicylindrical surface which joins said inner and outer wrap portions and is parallel to the orbital axis of said orbiting scroll member, and said stepped portion is a semicylindrical surface which joins said inner and outer end plate portions and is parallel to said orbital axis.

* * * * *